US010816287B1

(12) United States Patent
Russo et al.

(10) Patent No.: US 10,816,287 B1
(45) Date of Patent: Oct. 27, 2020

(54) BOLT CARRIER SPEED CONTROL APPARATUS

(71) Applicants: Carmelo Russo, New Port Richey, FL (US); Anthony Russo, New Port Richey, FL (US)

(72) Inventors: Carmelo Russo, New Port Richey, FL (US); Anthony Russo, New Port Richey, FL (US)

( * ) Notice: Subject to any disclaimer, the term of this patent is extended or adjusted under 35 U.S.C. 154(b) by 0 days.

(21) Appl. No.: 16/804,116

(22) Filed: Feb. 28, 2020

(51) Int. Cl.
*F41A 3/26* (2006.01)

(52) U.S. Cl.
CPC ..... *F41A 3/26* (2013.01)

(58) Field of Classification Search
CPC ..... F41A 3/26
USPC ..... 89/190, 198
See application file for complete search history.

(56) References Cited

U.S. PATENT DOCUMENTS 2,960,917 A * 11/1960 Lizza ..... F41A 3/26 89/190
7,299,737 B2 * 11/2007 Hajjar ..... F41A 3/46 89/180

* cited by examiner

*Primary Examiner* — Reginald S Tillman, Jr.
(74) *Attorney, Agent, or Firm* — Gulf Coast Intellectual Property Group

(57) ABSTRACT

A bolt carrier speed control apparatus that is configured to provide adjustable speed control of the bolt carrier during firing of a round of ammunition. The bolt carrier speed control apparatus is configured to be mounted in a first location or a second location. The bolt carrier speed control apparatus includes a body that is cylindrical in form. The body includes and interior volume and further includes a central bore extending longitudinally therethrough. Circumferentially disposed around the central core are a plurality of movement assemblies. The movement assemblies are configured to move in an inward-outward direction that is facilitated by traversal of an adjustment screw through the central bore. The movement assemblies include a wall engagement member that is configured to extend beyond the external surface of the body so as to engage a portion of the firearm and provide speed control of the bolt carrier through added friction.

16 Claims, 4 Drawing Sheets

BOLT CARRIER SPEED CONTROL APPARATUS

FIELD OF THE INVENTION

The present invention relates generally to firearms, more specifically but not by way of limitation, an apparatus that is configured to be operably disposed in the travel path of the bolt carrier assembly of a firearm wherein the apparatus is adjustable and functions to provide control of the cycle time speed of the bolt carrier.

BACKGROUND

Rifles such as but not limited to M16's and AR-15's can be configured in both automatic and semi-automatic configurations wherein these types of rifles are capable of firing a high capacity of ammunition rounds in short time periods. A critical component to these types of firearms is what is commonly known as a bolt carrier assembly. A conventional bolt carrier assembly includes elements such as but not limited to a bolt carrier, a bolt, a firing pin and a cam pin. Bolt carriers are generally cylindrical in shape having a bore throughout its length and further includes an opening on the top and bottom so as to permit a hammer to extend into the interior of the bolt carrier and strike the firing pin. During the cycle of a bolt carrier, the bolt carrier, or at least a portion thereof, will travel into what is known as the buffer tube. The buffer tube contains a spring and will facilitate the return of the bolt carrier so as to complete the cycle of the bolt carrier assembly.

One challenge when utilizing the aforementioned types of firearms is the control of accuracy during sessions of repeated rapid fire. For applications requiring accuracy in a rapid sequence at different adjacent targets, minimizing disruption is critical. Bolt carrier speed affects the cartridge ejection, blowback and ultimately causes deflection of the firearm during each round that is fired. While firearms such as the AR-15 utilize impingement system to control gas flow into the firing chamber, these do not control the speed of the cycle time of the bolt carrier assembly, only the control of gas flow to effect the cycle thereof.

Accordingly, there is a need for an apparatus that can be either operably coupled to the bolt carrier assembly or operably disposed within the buffer tube wherein the apparatus is configured to provide adjustment of the cycle time of the bolt carrier assembly.

SUMMARY OF THE INVENTION

It is the object of the present invention to provide an apparatus that is configured to provide adjustment of the bolt carrier assembly speed wherein the apparatus is operably coupled to a bolt carrier.

Another object of the present invention is to provide a bolt carrier speed control apparatus operably disposed within the travel path of the bolt carrier of a firearm wherein the apparatus of the present invention can additionally be configured to be disposed within the buffer tube of a firearm.

A further object of the present invention is to provide an apparatus that is configured to provide adjustment of the bolt carrier assembly speed wherein the apparatus includes a body wherein the body is cylindrical in shape.

An additional object of the present invention is to provide a bolt carrier speed control apparatus operably disposed within the travel path of the bolt carrier of a firearm wherein the body includes a first end and a second end and a central bore is present having an opening at the first end.

Yet a further object of the present invention is to provide an apparatus that is configured to provide adjustment of the bolt carrier assembly speed wherein an adjustment screw is operably disposed within the central bore.

A further object of the present invention is to provide a bolt carrier speed control apparatus operably disposed within the travel path of the bolt carrier of a firearm wherein the central bore includes a wall circumferentially disposed thereto wherein the wall is comprised of a plurality of movable segments.

Another object of the present invention is to provide an apparatus that is configured to provide adjustment of the bolt carrier assembly speed wherein the plurality of movable segments are operably coupled with spring members.

An additional object of the present invention is to provide bolt carrier speed control apparatus operably disposed within the travel path of the bolt carrier of a firearm wherein the spring members are operably coupled to mounting members.

Still a further object of the present invention is to provide an apparatus that is configured to provide adjustment of the bolt carrier assembly speed wherein the mounting members have operably coupled thereto chamber wall engagement members.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
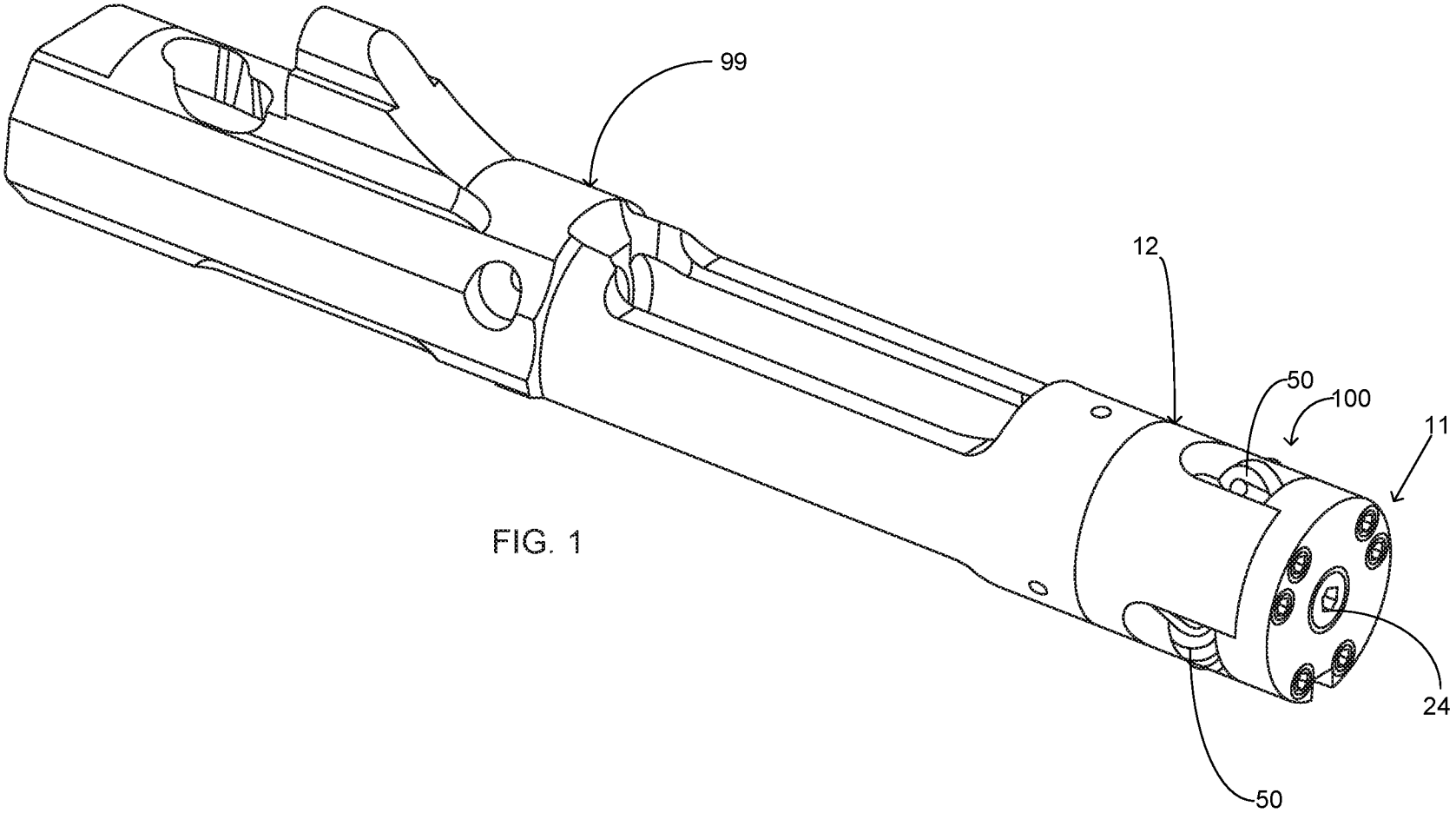
FIG. 1 is a perspective view of an exemplary bolt carrier with the present invention operably coupled thereto.
Figure 2:
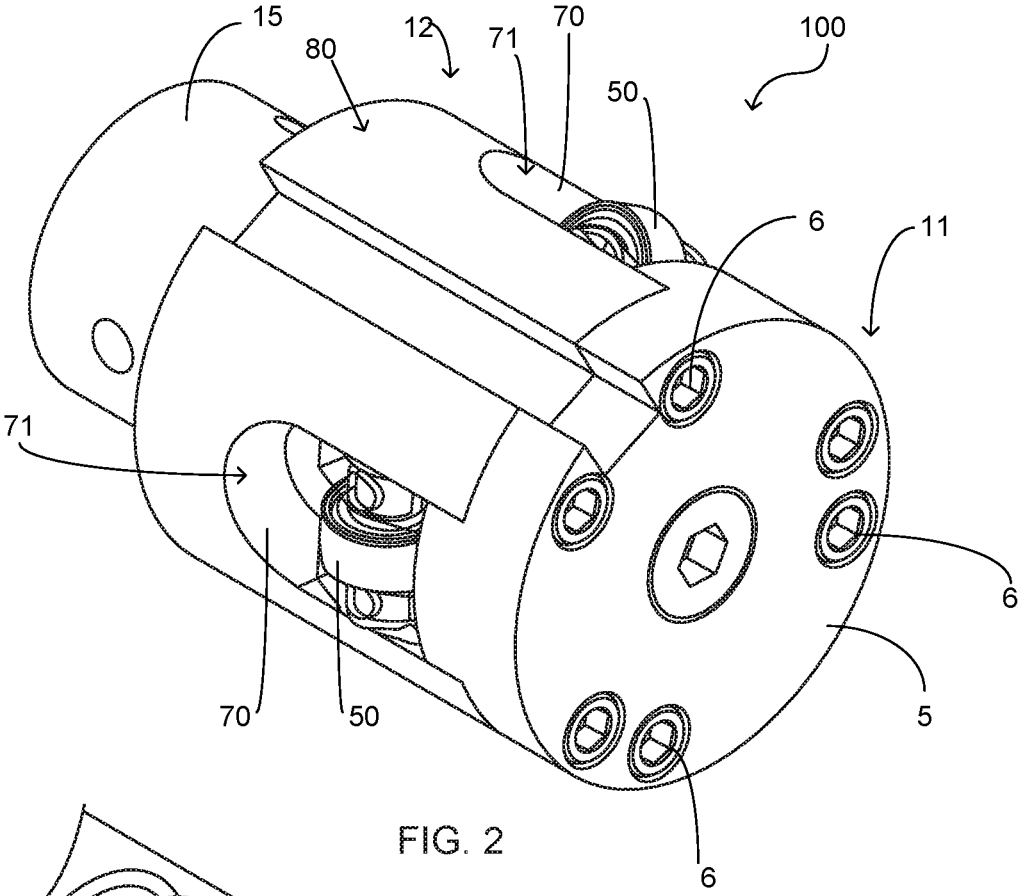
FIG. 2 is a perspective view of the present invention.
Figure 3:
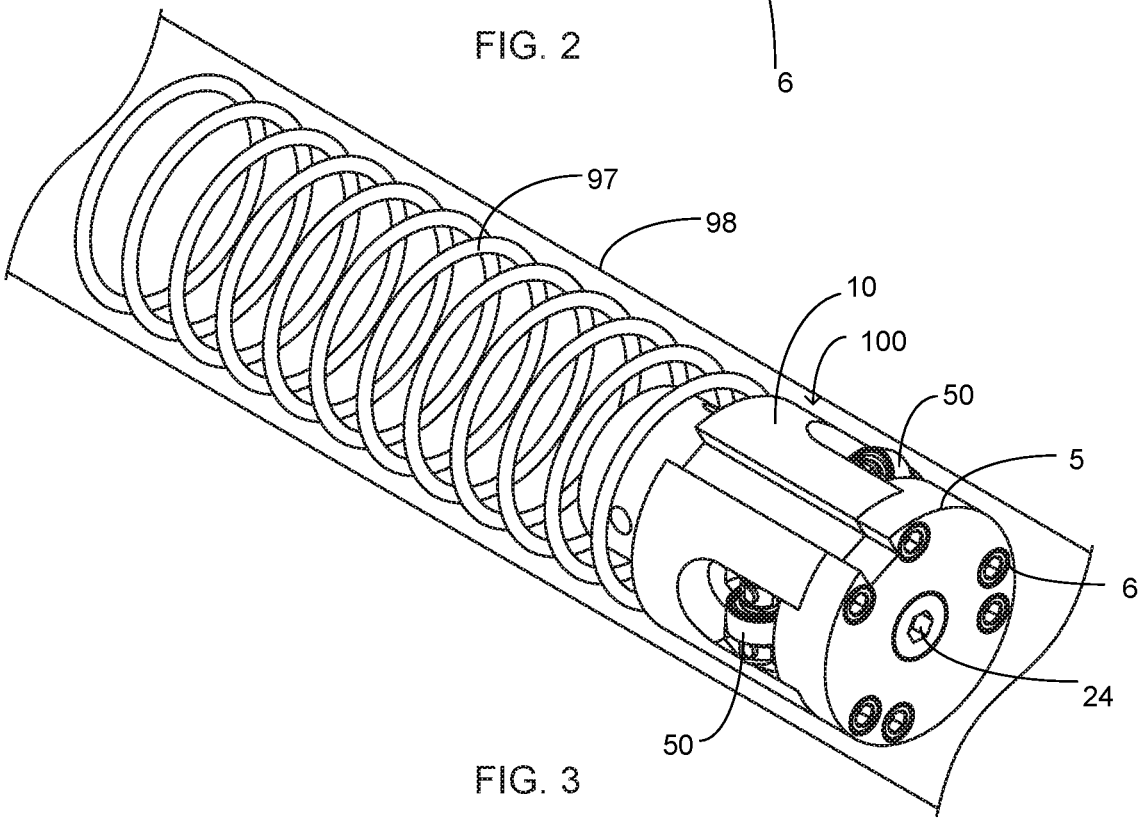
FIG. 3 is a perspective view of the present invention operably disposed in an exemplary buffer tube.
Figure 4:
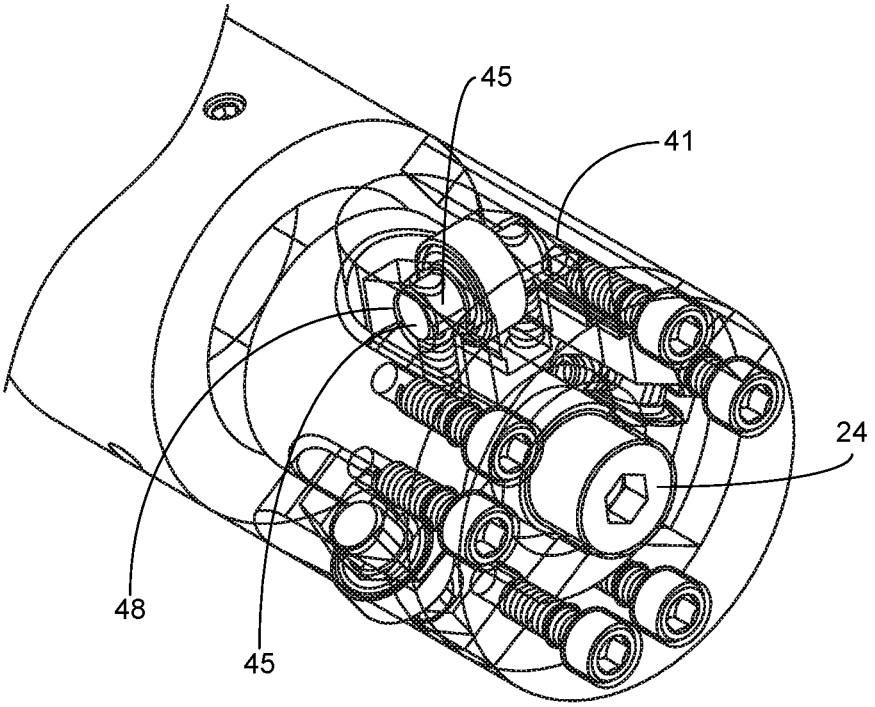
FIG. 4 is detailed perspective view of the present invention.
Figure 5:
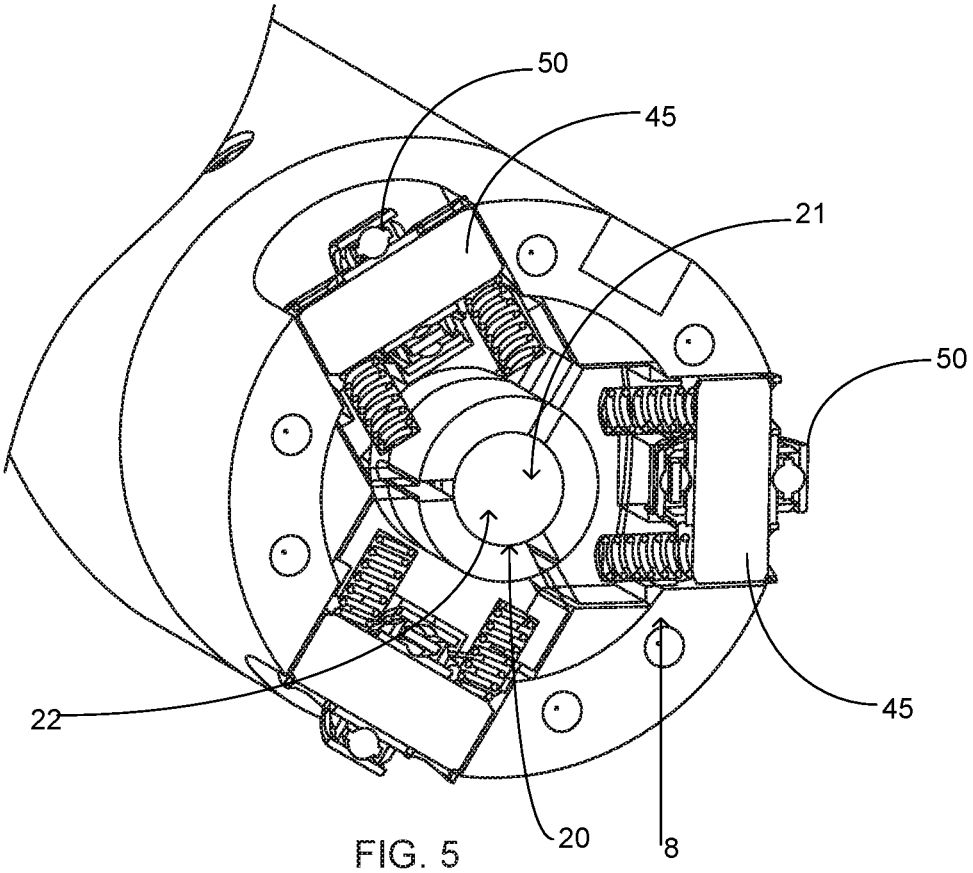
FIG. 5 is a detailed perspective end view of the present invention.
Figure 6:
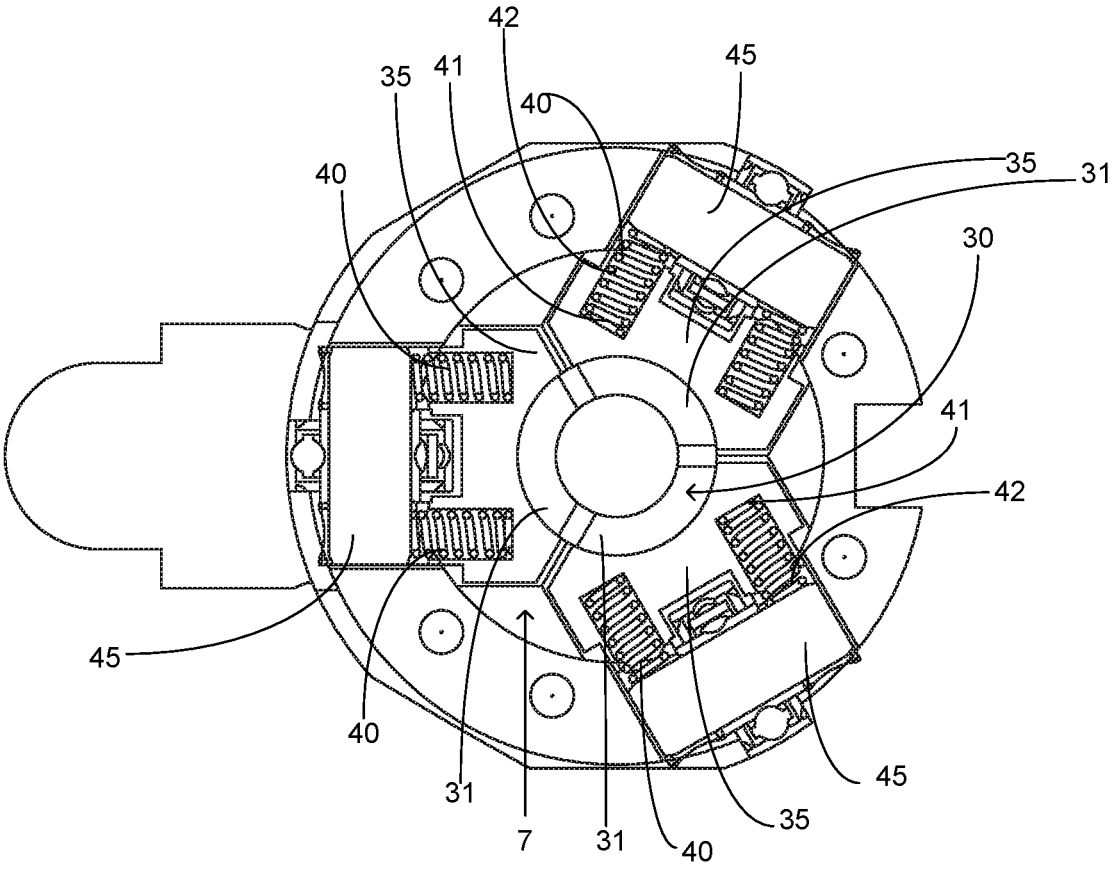
FIG. 6 is a detailed end view of the present invention.

Referring now to the drawings submitted herewith, wherein various elements depicted therein are not necessarily drawn to scale and wherein through the views and figures like elements are referenced with identical reference numerals, there is illustrated a bolt carrier speed control apparatus 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular to the Figures submitted herewith, the bolt carrier speed control apparatus 100 includes a body 10. The body 10 is manufactured from a suitable durable material such as but not limited to metal. The body 10 is cylindrical in shape and has suitable diameter to be operably coupled to a bolt carrier 99 or disposed within a buffer tube 98 of a firearm and not interfere with normal firing operations. The body 10 includes a first end 11 and second end 12. The body 10 includes an interior volume 7. The body 10 further includes slots 70 having openings 71 that are coupled with the interior volume 7 and provide a technique for a portion of the movement assemblies 8 to extend beyond the exterior surface 80 of the body 10 as is further discussed herein. The second end 12 has integrally formed therewith adapter 15. Adapter 15 is manufactured having a smaller diameter than body 10 and extends outward from the second end 12 of the body 10. The adapter 15 and is configured to be operably coupled with either the bolt carrier 99 or the buffer tube spring 97. As is further discussed herein, the bolt carrier speed control apparatus 100 is operable to provide adjustment of the speed of the cycle time of the bolt carrier during a firing round operation. The present invention provides a first technique and a second technique to accomplish the aforementioned objective. The bolt carrier speed control apparatus 100 can either be operably coupled to the bolt carrier 99 or disposed in the buffer tube 98 and operably coupled with the buffer tube spring 97 to accomplish the stated objective.

The body 10 further includes a cap member 5 secured thereto proximate first end 11. The cap member 5 is manufactured from a durable material such as but not limited to metal and is secured to the body 10 utilizing fasteners 6. The cap member 5 provides coverage and protection of the movement assemblies 8 which are further described herein and include in pertinent part a block member 35, spring members 40 and a wall engagement member 50. The cap member 5 is removable so as to provide access to the elements of the movement assemblies 8 for service and replacement thereof. It should be understood within the scope of the present invention that the body 10 could be manufactured without the cap member 5.

The body 10 includes a central bore 20 journaled in the middle thereof wherein the central bore 20 includes a hollow passage 21. The central bore 20 extends substantially through the body 10 and includes an opening 22 proximate the first end 11 of the body 10. While not particularly illustrated herein, in a preferred embodiment the inner wall of the central bore 20 is threaded so as to operably engage the adjustment screw 24. The adjustment screw 24 is operably inserted into the hollow passage 21 at opening 22. The central bore 20 has circumferentially disposed therearound a wall 30 wherein the wall 30 is comprised of segments 31. The segments 31 are movable via engagement with the adjustment screw 24. By way of example but not limitation, in a preferred embodiment, the segments 31 have a slight angular orientation proceeding from the first end 11 to the second end 12. As the adjustment screw 24 is journaled into the hollow passage 21 the segments 31 are moved in an outward direction away from the hollow passage 21 and as further discussed herein results in the transition of movement assemblies 8 and the elements thereof from a first position to a second position. In the first position the wall engagement member 50 is not operably coupled with an inner wall surface of a firing chamber and/or a buffer tube 98. In the second position the movement assemblies 8 have been moved so as to effect the operable engagement of the wall engagement member 50 with an inner surface of a wall of a firing chamber and/or buffer tube 98. In the second position the movement assemblies 8 impact the speed of the bolt carrier 99 during a firing round cycle so as to reduce the cycle speed. It should be understood within the scope of the present invention that the segments 31 could be moved utilizing alternate elements or techniques. Furthermore, while three segments 31 are illustrated herein, it should be understood as few as one segment 31 or more than three segments 31 could be employed.

The segments 31 are contiguously formed with block members 35. Block members 35 move in tandem with the segments 31 and are manufactured from a durable material such as but not limited to metal. The block members 35 include spring members 40 operably coupled therewith. Spring members 40 are conventional metal springs manufactured from a resilient metal. Each block member 35 has two spring members distally located with an axle member 45 operably coupled therebetween. The spring members 40 are operable to provide the variable force to the wall engagement members 50 so as to control the cycle speed of the bolt carrier 99. As the adjustment screw 24 is traversed farther into the hollow passage 21, the segments 31 and as such the block members 35 move in an outward direction. The outward directional movement results in the wall engagement members 50 to operably engage the inner surface of the walls of either the anterior portion of the firing chamber of a firearm and/or the inner surface of the walls of the buffer tube 98. The spring members 40 are configured to provide an increasing variable force to the wall engagement members 50 so as to control the rate of travel of the bolt carrier 99 during the firing of a round of ammunition. The spring members 40 include a first end 41 and second end 42 with the axle member 45 being operably coupled intermediate the second ends 42 of the spring members 40 secured into the same block member 35. While two spring members 40 are illustrated herein, it is contemplated within the scope of the present invention that one spring member could be employed or more than two spring members.

Axle members 45 are manufactured from a durable material such as but not limited to metal and are rotatably mounted with end housings 47, 48 intermediate adjacent spring members 40. The wall engagement member 50 is rotatably mounted to the axle member 50 and is annular in shape. The wall engagement member 50 is manufactured from a durable material such as but not limited to metal and is configured to frictionally and rotationally engage inner surfaces of either the buffer tube 98 and/or a portion of a firing chamber of a firearm. The greater the variable force applied to the spring members 40 results in an increased force applied by the wall engagement member 50. An increased force applied by the wall engagement member 50 results in the decrease in the speed of the bolt carrier 99 during the firing of a round of ammunition. While the wall engagement members 50 are illustrated as wheels in the Figures submitted as a part hereof, it should be understood within the scope of the present invention that the wall engagement members 50 could be manufactured in various forms and/or shapes in order to achieve the desired objective stated herein. While the embodiment illustrated herein of the bolt carrier speed control apparatus 100 includes three wall engagement members 50, it is contemplated within the scope of the present invention that the bolt carrier speed control apparatus 100 could include as few as one wall engagement member 50 and the elements operably coupled thereto. Alternatively, a pair of diametrically opposed wall engagement members 50 and the associative elements could be employed. Lastly, while three wall engagement members 50 are illustrated herein, it should be understood within the scope of the present invention that the bolt carrier speed control apparatus 100 could employ more than three wall engagement members 50.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A bolt carrier speed control apparatus configured to provide control of bolt carrier speed during firing of a round of ammunition wherein the bolt carrier speed control apparatus comprises:

a body, said body being cylindrical in shape, said body having a first end and a second end, said body having an outer surface, said body having an interior volume said body further including an adapter, said adapter being contiguously formed with said second end of said body, said adapter having a diameter that is less than that of said body;

at least one movement assembly, said at least one movement assembly being operably disposed within said interior volume of said body, said at least one movement assembly being movable intermediate a first position and a second position, wherein said movement assembly includes at least one spring, said spring being operably coupled to a wall engagement member, said wall engagement member configured to bias against a wall of a portion of a firearm during a firing of a round of ammunition, said at least one movement assembly being disposed within the interior volume of said body in said first position, said at least one movement assembly having a portion thereof extending beyond the outer surface of said body in said second position; and wherein the bolt carrier speed control apparatus is operably located in a first location or a second location, wherein in said first location said body is operably coupled to an end of a bolt carrier and wherein in said second location said body is operably disposed within a buffer tube.

2. The bolt carrier speed control apparatus as recited in claim 1, and further including a central bore, said central bore having a hollow passage, said central bore being longitudinally and centrally located in said body, said central bore having an opening proximate said first end, said central bore configured to receive an adjustment element in the hollow passage thereof.

3. A bolt carrier speed control apparatus configured to provide control of bolt carrier speed during firing of a round of ammunition wherein the bolt carrier speed control apparatus comprises:

a body, said body being cylindrical in shape, said body having a first end and a second end, said body having an interior volume, said body having an external surface, said body further including a central bore, said central bore having a hollow passage, said central bore having an opening proximate said first end of said body, said central bore extending longitudinally through said body towards said second end;

a plurality of movement assemblies, said plurality of movement assemblies being disposed within the interior volume of said body, said plurality of movement assemblies circumferentially disposed around said central bore, said plurality of movement assemblies being independently movable, said plurality of assemblies configured to be movable in an inward-outward direction, said plurality of movement assemblies configured to have a portion thereof extend outward from said external surface so as to engage a portion of a firearm in which the bolt carrier speed control apparatus is installed; and wherein the bolt carrier speed control apparatus is operably located in a first location or a second location.

4. The bolt carrier speed control apparatus as recited in claim 3, wherein said plurality of movement assemblies include a plurality of block members, said plurality of block members being adjacent to said central bore.

5. The bolt carrier speed control apparatus as recited in claim 4, wherein said plurality of block members includes at least one spring member, said spring member being operably coupled to said plurality of block members distal to said central bore.

6. The bolt carrier speed control apparatus as recited in claim 5, wherein said spring member has operably coupled thereto a wall engagement member, said wall engagement member being operably coupled to said spring member distal to said plurality of block members.

7. The bolt carrier speed control apparatus as recited in claim 6, wherein at least a portion of said wall engagement member is configured to be moved beyond the external surface of said body.

8. The bolt carrier speed control apparatus as recited in claim 7, and further including an adjustment screw, said adjustment screw being operably coupled with said central bore, said adjustment screw configured to traverse within said hollow passage of said central bore, wherein positioning of said adjustment screw within said hollow passage of said central bore facilitates the inward-outward movement of said plurality of movement assemblies.

9. The bolt carrier speed control apparatus as recited in claim 8, wherein in said first location said body is operably coupled to an end of a bolt carrier.

10. The bolt carrier speed control apparatus as recited in claim 8, wherein in said second location said body is operably disposed within a buffer tube.

11. A bolt carrier speed control apparatus configured to provide control of bolt carrier speed during firing of a round of ammunition wherein the bolt carrier speed control apparatus comprises:

a body, said body being cylindrical in shape, said body having a first end and a second end, said body having an interior volume, said body having an external surface, said body further having slots wherein said slots have an opening in said external surface and are contiguous with a cavity in the interior volume of said body, said body further including a central bore, said central bore having a hollow passage, said central bore having an opening proximate said first end of said body, said central bore extending longitudinally through said body towards said second end, said body further including an adapter, said adapter being contiguously formed with said second end of said body, said adapter having a diameter less than that of said body, said adapter extending outward from said second end;

a plurality of movement assemblies, said plurality of movement assemblies being disposed within the interior volume of said body, said plurality of movement assemblies including block members that are circumferentially disposed around said central bore, said plurality of movement assemblies being independently movable, said plurality of assemblies configured to be movable in an inward-outward direction, said plurality of movement assemblies having a first spring member and a second spring member, said first spring member and said second spring member being distal to said central bore, said first spring member and said second spring member being opposedly located on said block members, said plurality of movement assemblies configured to have a portion thereof extend outward from said external surface so as to engage a portion of a firearm in which the bolt carrier speed control apparatus is installed; and wherein the bolt carrier speed control apparatus is operably located in a first location or a second location.

12. The bolt carrier speed control apparatus as recited in claim 11, and further including an axle member, said axle member being mounted intermediate said first spring member and said second spring member, said axle member being distal to said block member.

13. The bolt carrier speed control apparatus as recited in claim 12, and further including a wall engagement member, said wall engagement member being operably coupled to said axle member, said wall engagement member configured to extend beyond said opening of said slots of said body.

14. The bolt carrier speed control apparatus as recited in claim 13, and further including an end cap member, said end cap member being secured to said first end of said body, said end cap member being secured with a plurality of fasteners.

15. The bolt carrier speed control apparatus as recited in claim 14, wherein in said first location said body is operably coupled to an end of a bolt carrier.

16. The bolt carrier speed control apparatus as recited in claim 15, wherein in said second location said body is operably disposed within a buffer tube.

* * * * *